US007959462B2

(12) United States Patent
Yoon et al.

(10) Patent No.: US 7,959,462 B2
(45) Date of Patent: Jun. 14, 2011

(54) CONNECTOR WITH A HOUSING WITH A PLURALITY OF PIN HOLES AND CONNECTION PINS EXTENDING FROM THE HOUSING

(75) Inventors: Kyung-jin Yoon, Seoul (KR); In-beom Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/855,966

(22) Filed: Aug. 13, 2010

(65) Prior Publication Data

US 2011/0059627 A1 Mar. 10, 2011

(30) Foreign Application Priority Data

Sep. 8, 2009 (KR) ..... 10-2009-0084502

(51) Int. Cl.
*H01R 13/60* (2006.01)

(52) U.S. Cl. ..... 439/541.5

(58) Field of Classification Search ..... 439/541.5, 439/660, 552, 79, 581, 540
See application file for complete search history.

(56) References Cited

U.S. PATENT DOCUMENTS

| | | | | |
|---|---|---|---|---|
| 5,080,609 | A * | 1/1992 | Fabian et al. | 439/541.5 |
| 5,643,008 | A * | 7/1997 | Tan et al. | 439/541.5 |
| 5,685,729 | A * | 11/1997 | Reider et al. | 439/206 |
| 6,033,258 | A * | 3/2000 | Huang et al. | 439/541.5 |
| 6,095,853 | A * | 8/2000 | Huang et al. | 439/541.5 |
| 6,811,434 | B2 * | 11/2004 | Wu | 439/567 |
| 7,824,210 | B2 * | 11/2010 | Oka et al. | 439/372 |
| 2010/0009569 | A1 * | 1/2010 | Su et al. | 439/552 |
| 2010/0255712 | A1 * | 10/2010 | Huang et al. | 439/502 |

* cited by examiner

*Primary Examiner* — Chandrika Prasad
(74) *Attorney, Agent, or Firm* — Sughrue Mion, PLLC

(57) ABSTRACT

A connector is provided which includes a housing having a plurality of pinholes which are connectable to a signal cable and through which a plurality of electrical signals are transmitted or received, and a plurality of connection pins extending from the housing where a first end of each connection pin is electrically connected to at least one of the plurality of pinholes, and a second end of each connection pin is mountable on a printed circuit board (PCB), wherein the total number of the plurality of connection pins is less than the total number of the plurality of pinholes.

17 Claims, 3 Drawing Sheets

CONNECTOR WITH A HOUSING WITH A PLURALITY OF PIN HOLES AND CONNECTION PINS EXTENDING FROM THE HOUSING

CROSS-REFERENCE TO RELATED APPLICATIONS

This application claims priority from Korean Patent Application No. 10-2009-0084502, filed on Sep. 8, 2009, in the Korean Intellectual Property Office, the disclosure of which is incorporated herein by reference in its entirety.

BACKGROUND

1. Field

Apparatuses consistent with the exemplary embodiments relate to a connector through which electrical signals are transmitted and received.

2. Description of the Related Art

In general, connectors are used to transceive, i.e., transmit and/or receive, electrical signals to and from two electronic apparatuses. These connectors may include, for example, D-subminiature (D-SUB) connectors through which video signals are transmitted to and received from computers and monitors. A D-SUB connector is mounted on a printed circuit board (PCB) in a computer or monitor, and is connected to a signal cable in order to transceive video signals. The D-SUB connector includes a plurality of connection pins to individually transfer color signals, such as a red signal R, a green signal G and a blue signal B, horizontal synchronizing signals, or vertical synchronizing signals. A related art D-SUB connector includes 15 connection pins.

Recently, many efforts to make electronic apparatuses compact are being made, and the size of main boards of electronic apparatuses needs to be reduced accordingly. Main boards include connectors disposed therein to transmit or receive electrical signals to or from external apparatuses, and thus there is a need to reduce the area occupied by the connectors in the main boards.

SUMMARY

Exemplary embodiments overcome the above disadvantages and other disadvantages not described above. Also, an exemplary embodiment is not required to overcome the disadvantages described above, and may not overcome any of the problems described above.

Exemplary embodiments of the present invention provide a connector through which electrical signals are transceived. The term "transceive" as used throughout the disclosure means transmit and/or receive.

According to an aspect of an exemplary embodiment, there is provided a connector including a housing including a plurality of pinholes which are connectable to a signal cable and through which a plurality of electrical signals are transmitted or received, and a plurality of connection pins extending from the housing wherein a first end of each connection pin is electrically connected to at least one of the plurality of pinholes, and a second end of each connection pin is mountable on PCB, wherein a total number of the plurality of connection pins is less than a total number of the plurality of pinholes.

One of the plurality of connection pins may be electrically connected to all pinholes corresponding to a ground among the plurality of pinholes.

The housing may comprise a metal shell which encloses the plurality of pinholes and is electrically connected to the pinholes corresponding to the ground.

The plurality of connection pins may be bent at a substantial right angle.

The plurality of pinholes may be arranged in three rows in a longitudinal direction of the housing, and the plurality of connection pins may be arranged in two rows in the longitudinal direction of the housing.

The total number of the plurality of pinholes may be 15, and the total number of the plurality of connection pins may be 10.

The signal cable may be inserted into the connector, while being positioned in parallel with the PCB.

The connector may be a D-SUB connector.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
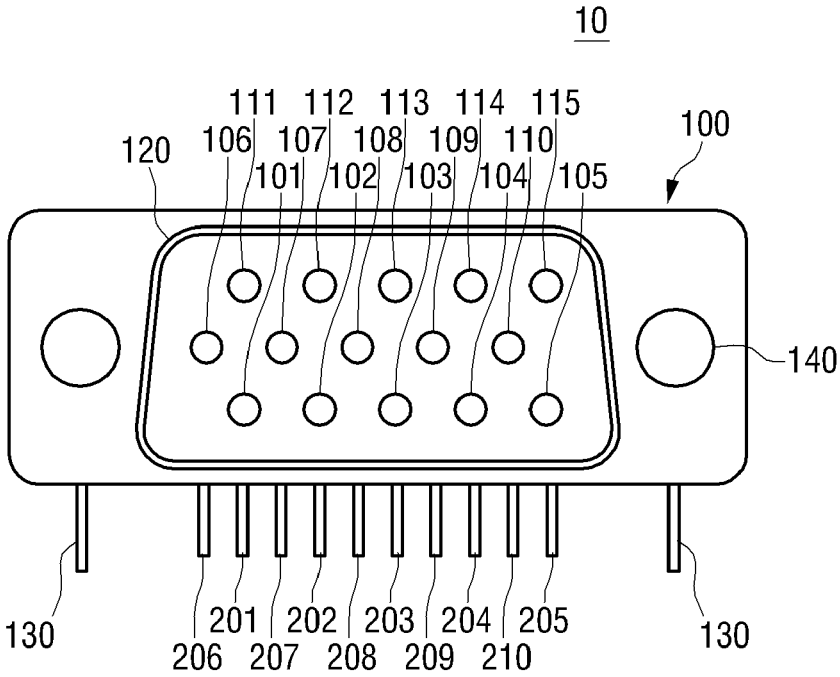
FIG. 1 is a front view of a D-SUB connector according to an exemplary embodiment.

Certain exemplary embodiments will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

A connector according to an exemplary embodiment is used to transceive electrical signals to and/or from two electronic apparatuses. The exemplary embodiments will be described with reference to a D-SUB connector, but there is no limitation to the type of connector. Accordingly, exemplary embodiments are also applicable to connectors other than the D-SUB connector.

Figure 2:
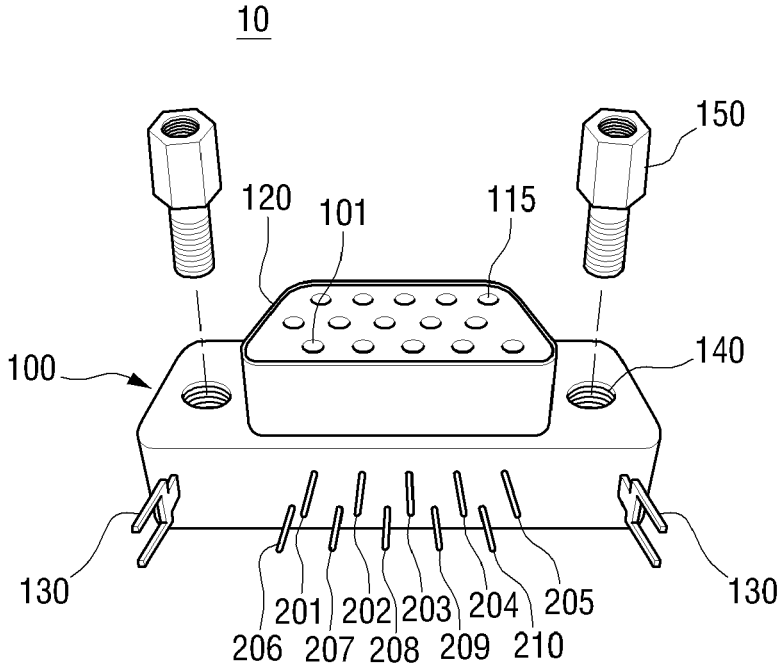
FIG. 2 is a perspective view of the D-SUB connector shown in FIG. 1.
Figure 3:
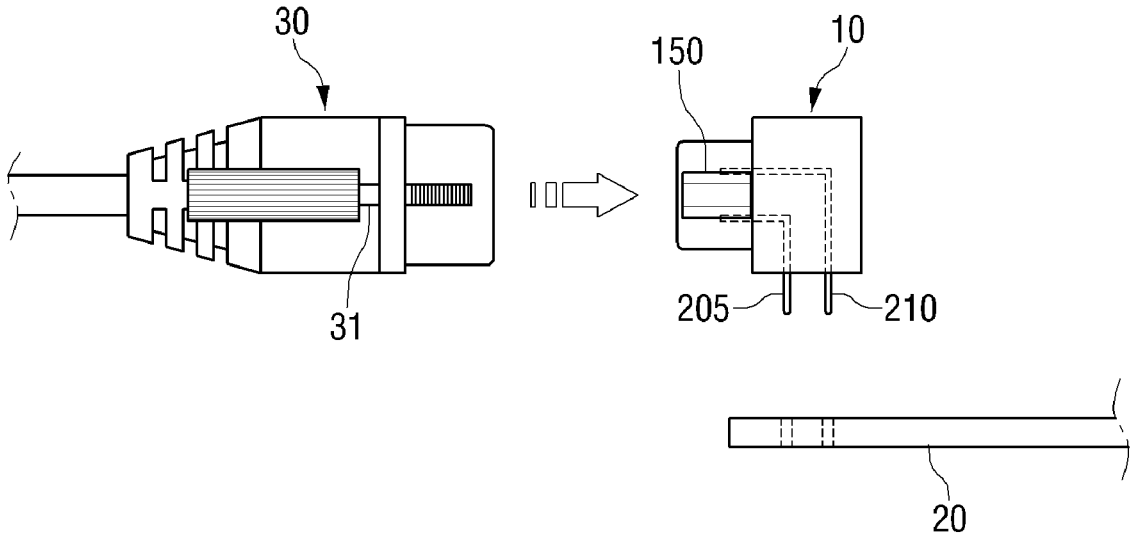
FIG. 3 is a side view of the D-SUB connector shown in FIG. 1 and a signal cable being connected to each other.
Figure 4:
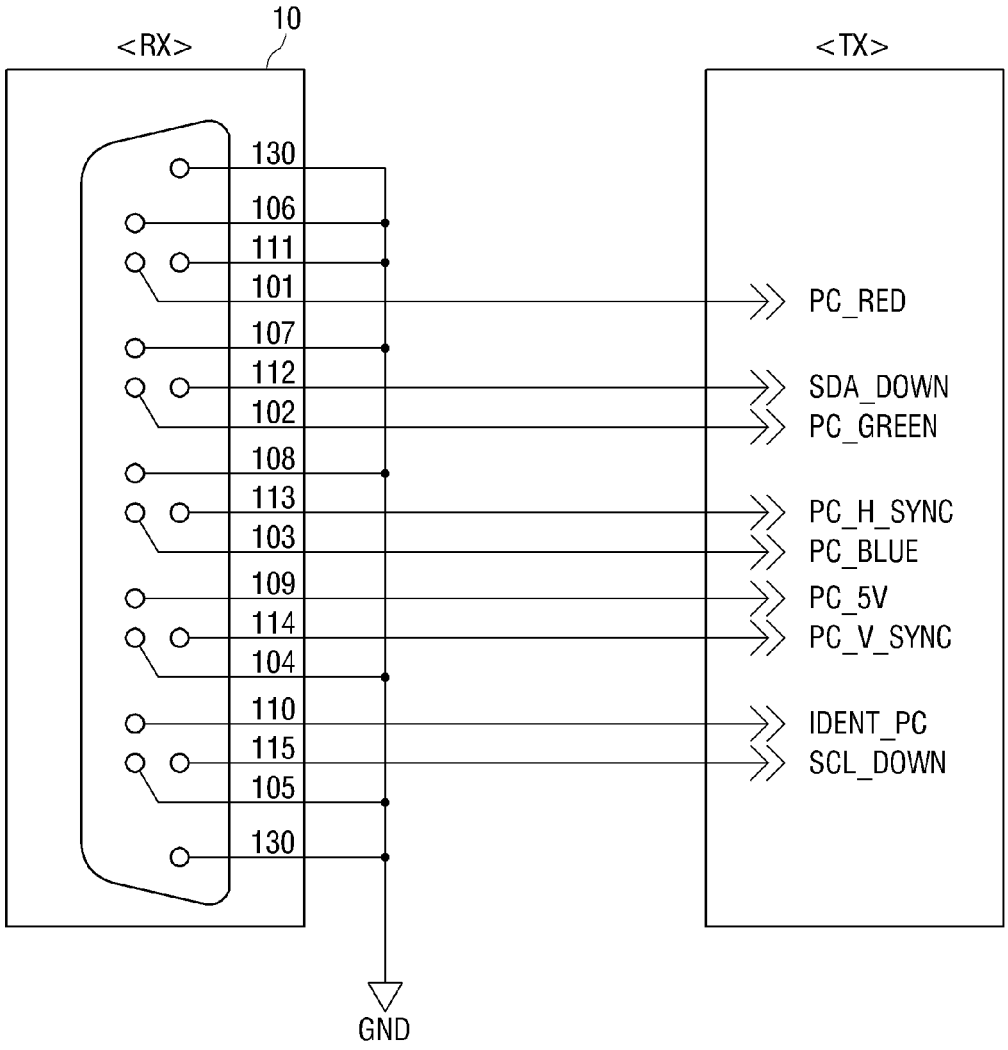
FIG. 4 is a circuit diagram of the D-SUB connector shown in FIG. 1.

FIG. 1 is a front view of a D-SUB connector 10 according to an exemplary embodiment, FIG. 2 is a perspective view of the D-SUB connector 10, FIG. 3 is a side view of the D-SUB connector 10 and a signal cable 30 being connected to each other, and FIG. 4 is a circuit diagram of the D-SUB connector 10.

The D-SUB connector 10 shown in FIG. 1 connects a computer and a monitor, and transceives video signals to and from the computer and the monitor. Additionally, the D-SUB connector 10 is mounted on a printed circuit board (PCB) 20 included in the computer or monitor as shown in FIG. 3. The signal cable 30 is inserted into the D-SUB connector 10, so that the computer is connected to the monitor. The D-SUB connector 10 includes a housing 100 and a plurality of connection pins 201-210.

The housing 100 forms an external structure of the D-SUB connector 10, and includes a plurality of pinholes 101-115, a metal shell 120, fixing pins 130 and a screw hole 140.

The plurality of pinholes 101-115 are connected to the signal cable 30 and transceive a plurality of electrical signals (namely, video signals in the exemplary embodiment). The signal cable 30 includes a plurality of pins (not shown) corresponding to the plurality of pinholes 101-115 shown in FIG. 1. The position and shape of the plurality of pinholes 101-115, or signals transceived by the plurality of pinholes 101-115 is typically set according to an industry standard. For example, the plurality of pinholes 101-115 are arranged in three horizontal rows in the D-SUB connector 10, as shown in FIG. 1.

FIG. 4 shows electrical signals transceived by the plurality of pinholes 101-115. A first pinhole 101, a second pinhole 102 and a third pinhole 103 are signal pinholes to transceive a red signal R (PC_RED), a green signal G (PC_GREEN) and a blue signal B (PC_BLUE), respectively. A fourth pinhole 104 and a fifth pinhole 105 are ground pinholes. A sixth pinhole 106, a seventh pinhole 107 and a eight pinhole 108 are ground pinholes for the red signal R, the green signal G and the blue signal B, respectively. A ninth pinhole 109 receives 5V of power (PC_5V), and a tenth pinhole 110 is a signal pinhole to transceive a mounting signal (IDENT_PC) of the signal cable 30. An eleventh pinhole 111 is a ground pinhole, and a twelfth pinhole 112 is a signal pinhole to transceive a resolution signal (SDA_DOWN). A thirteenth pinhole 113, a fourteenth pinhole 114 and a fifteenth pinhole 115 are signal pinholes to transceive a horizontal synchronizing signal (PC_H_SYNC), a vertical synchronizing signal (PC_V_SYNC) and a resolution signal (SCL_DOWN), respectively. As described above, the electrical signals transceived by the plurality of pinholes 101-115 in the exemplary embodiment are merely exemplary, and accordingly the electrical signals may be appropriately modified and applied to other exemplary embodiments.

As shown in FIGS. 1 and 2, the metal shell 120 encloses the plurality of pinholes 101-115, and provides mechanical support for engagement with the signal cable 30.

The fixing pins 130 are used to fix the D-SUB connector 10 to the PCB 20, and are disposed on both sides of a bottom surface of the D-SUB connector 10. The fixing pins 130 may function as the ground, as shown in FIG. 4.

A fastening member 150 is fastened into the screw hole 140, as shown in FIG. 2. The signal cable 30 is inserted into the D-SUB connector 10 and a fastening bolt 31 (see FIG. 3) of the signal cable 30 is fitted into the fastening member 150, and thus it is possible to prevent the signal cable 30 from being separated from the D-SUB connector 10.

A first end of the plurality of connection pins 201-210 is electrically connected to the plurality of pinholes 101-115, and a second end of the plurality of connection pins 201-210 is connected to the PCB 20. The number of connection pins 201-210 is less than the number of pinholes 101-115. In the exemplary embodiment, ten connection pins 201-210 are arranged in two horizontal rows, as shown in FIG. 2. However, in a related art D-SUB connector, the number of connection pins is equal to the number of pinholes, and 15 connection pins are arranged in three horizontal rows.

In the exemplary embodiment, the first connection pin 201, second connection pin 202, third connection pin 203, fourth connection pin 204 and fifth connection pin 205 are connected to the first pinhole 101, second pinhole 102, third pinhole 103, ninth pinhole 109 and tenth pinhole 110, respectively. A sixth connection pin 206 is connected to the fourth pinhole 104, fifth pinhole 105, sixth pinhole 106, seventh pinhole 107, eighth pinhole 108 and eleventh pinhole 111. Additionally, the seventh connection pin 207, eight connection pin 208, ninth connection pin 209 and tenth connection pin 210 are connected to the twelfth pinhole 112, thirteenth pinhole 113, fourteenth pinhole 114 and fifteenth pinhole 115, respectively. In other words, one of the plurality of connection pins 201-210 (e.g., the sixth connection pin 206) is electrically connected to pinholes corresponding to the ground among the plurality of pinholes 101-115 (e.g., the fourth pinhole 104, fifth pinhole 105, sixth pinhole 106, seventh pinhole 107, eighth pinhole 108 and eleventh pinhole 111), and thus the number of connection pins may be reduced from 15 to 10. In addition, the fourth pinhole 104, fifth pinhole 105, sixth pinhole 106, seventh pinhole 107, eighth pinhole 108 and eleventh pinhole 111 which correspond to the ground, may be electrically connected to the metal shell 120, and grounded.

The connection relationship between the plurality of connection pins 201-210 and the plurality of pinholes 101-115 may be appropriately changed. For example, one connection pin other than the sixth connection pin 206 may be connected to the fourth pinhole 104, fifth pinhole 105, sixth pinhole 106, seventh pinhole 107, eighth pinhole 108 and eleventh pinhole 111 which correspond to the ground.

As described above, the fourth pinhole 104, fifth pinhole 105, sixth pinhole 106, seventh pinhole 107, eighth pinhole 108 and eleventh pinhole 111 are grounded together, so as to facilitate improvement of electromagnetic interference (EMI). Additionally, these pinholes are grounded automatically within the D-SUB connector 10, and accordingly there is no need to form a pattern for grounding these pinholes together in the PCB 20 in which the D-SUB connector 10 is mounted.

If gaps between the connection pins are narrow, inferior goods may be produced in manufacturing the D-SUB connector, or in a process of punching the PCB 20 to mount the D-SUB connector in the PCB 20. However, according to the exemplary embodiment, the number of connection pins 201-210 in the D-SUB connector 10 is reduced compared to the related art D-SUB connector, and thus it is possible to widen gaps between the connection pins 201-210. Therefore, it is possible to prevent production of inferior goods.

Referring to FIG. 3, the signal cable 30 may be inserted into the D-SUB connector 10 while being positioned in parallel with the PCB 20. FIG. 3 does not illustrate the fixing pin 130 in order to show the connection pins 205 and 210 in the D-SUB connector 10. In FIG. 3, the direction in which the D-SUB connector 10 is mounted in the PCB 20 is perpendicular to the direction in which the signal cable 30 is inserted into the D-SUB connector 10, and accordingly, the plurality of connection pins 201-210 are bent substantially at a right angle. In this situation, an area occupied by the D-SUB connector 10 in the PCB 20 is the bottom surface of the D-SUB connector 10, not the front surface. As described above, the number of connection pins 201-210 on the bottom surface of the D-SUB connector 10 is reduced, and thus it is possible to reduce the area occupied by the D-SUB connector 10 in the PCB 20, thereby making the PCB 20 compact.

The D-SUB connector 10 for transceiving video signals to and from the computer and monitor has been explained above, but this is merely an example. Accordingly, exemplary embodiments of the present invention are also applicable to other connectors.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A connector comprising:

a housing comprising a plurality of pinholes which are connectable to a signal cable and through which a plurality of electrical signals are transmitted or received; and a plurality of connection pins extending from the housing wherein a first end of each connection pin is electrically connected to at least one of the plurality of pinholes, and a second end of each connection pin is mountable on a printed circuit board (PCB), wherein a total number of the plurality of connection pins is less than a total number of the plurality of pinholes.

2. The connector as claimed in claim 1, wherein one of the plurality of connection pins is electrically connected to all pinholes corresponding to a ground among the plurality of pinholes.

3. The connector as claimed in claim 2, wherein the housing comprises a metal shell which encloses the plurality of pinholes and is electrically connected to the pinholes corresponding to the ground.

4. The connector as claimed in claim 1, wherein the plurality of connection pins are bent at a substantial right angle.

5. The connector as claimed in claim 1, wherein the plurality of pinholes are arranged in three rows in a longitudinal direction of the housing, and the plurality of connection pins are arranged in two rows in the longitudinal direction of the housing.

6. The connector as claimed in claim 1, wherein the total number of the plurality of pinholes is 15, and the total number of the plurality of connection pins is 10.

7. The connector as claimed in claim 1, wherein the plurality of pinholes and the plurality of connection pins are arranged such that a signal cable is insertable into the connector, while the signal cable is positioned in parallel with the PCB.

8. The connector as claimed in claim 1, wherein the connector is a D-SUB connector.

9. A connector comprising:

a housing comprising a plurality of pinholes which are connectable to a signal cable; and a plurality of connection pins extending from the housing wherein a first end of each connection pin is electrically connected to at least one of the plurality of pinholes, and a second end of each connection pin is mountable on a printed circuit board, wherein the first end of at least one of the plurality of connection pins is electrically connected to more than one of the plurality of pinholes.

10. The connector according to claim 9, wherein a total number of the plurality of connection pins is less than a total number of the plurality of pinholes.

11. The connector according to claim 9, wherein the at least one of the plurality of connection pins that is electrically connected to more than one of the plurality of pinholes is electrically connected to all pinholes corresponding to a ground among the plurality of pinholes.

12. The connector according to claim 11, wherein the housing comprises a metal shell which encloses the plurality of pinholes and is electrically connected to the pinholes corresponding to the ground.

13. The connector according to claim 9, wherein the plurality of connection pins are bent at a substantial right angle.

14. The connector according to claim 9, wherein the plurality of pinholes are arranged in three rows in a longitudinal direction of the housing, and the plurality of connection pins are arranged in two rows in the longitudinal direction of the housing.

15. The connector according to claim 9, wherein the total number of the plurality of pinholes is 15, and the total number of the plurality of connection pins is 10.

16. The connector according to claim 9, wherein the plurality of pinholes and the plurality of connection pins are arranged such that a signal cable is insertable into the connector, while the signal cable is positioned in parallel with the PCB.

17. The connector according to claim 9, wherein the connector is a D-SUB connector.

* * * * *